United States Patent [19]

Tsuchiya et al.

[11] Patent Number: 4,988,662

[45] Date of Patent: Jan. 29, 1991

[54] THERMOSENSITIVE RECORDING SHEET

[75] Inventors: Kikuo Tsuchiya, Nishinomiya; Masaji Inagaki, Ashiya; Shingo Araki, Kobe, all of Japan

[73] Assignee: Dainippon Ink and Chemicals, Inc., Tokyo, Japan

[21] Appl. No.: 343,674

[22] Filed: Apr. 27, 1989

[30] Foreign Application Priority Data

Apr. 27, 1988 [JP] Japan ..... 63-102441

[51] Int. Cl.[5] ..... B41M 5/18

[52] U.S. Cl. ..... 503/208; 503/209; 503/225

[58] Field of Search ..... 427/150–152; 503/208, 209, 225

[56] References Cited

FOREIGN PATENT DOCUMENTS 1263794 11/1986 Japan ..... 503/209

*Primary Examiner*—Bruce H. Hess

*Attorney, Agent, or Firm*—Sherman and Shalloway

[57] ABSTRACT

A thermosensitive recording sheet comprising a substrate sheet and coated on the substrate, a film comprising a color-forming lactone compound, an acidic substance and a sensitizer, said sensitizer being a substituted or unsubstituted phenacyl ether compound or a substituted or unsubstituted phenacyl sulfide compound.

11 Claims, No Drawings

THERMOSENSITIVE RECORDING SHEET

The present invention relates to a thermosensitive recording sheet having very high color-forming sensitivity and excellent stability at the colored and non-colored portions.

Thermosensitive recording sheets are designed to display thereon images such as characters and geometric figures by thermal energy, and have recently found applications in various printer recorders, facsimiles, POS labels, automatic ticket examination, etc. There are various methods of thermosensitive recording. From the viewpoint of the clearness, resolution and color of images, the most prevalent method is to use a color-forming lactone compound such as Crystal Violet Lactone which is a dye precursor and an acidic substance capable of allowing the lactone compound to form a color.

In this method, a phenolic compound such as bisphenol A which is solid at room temperature but upon heating, is melted and acts as an acid component has conventionally been used as the acidic substance. Thermosensitive recording sheets used in this case are required to have a high degree of whiteness and excellent stability at the colored portion and the non-colored portion. Usually, to obtain a brilliant color, the sheets must be maintained at a temperature of about 140°-150° C. for a period of time above a certain limit. Hence, various approaches have been made in order to obtain brilliant colors more rapidly and more easily, and various research results have been reported. For example, there are a method in which stearamide or the like is added as a sensitizer (Japanese Laid-Open Patent Publication No. 139740/1979), and a method in which benzyl p-hydroxybenzoate or the like is used as the acidic substance (Japanese Laid-Open Patent Publication No. 74762/1979).

However, these known methods are still not entirely satisfactory although they can increase color-forming sensitivity, and are not satisfactory either with respect to the stability of the colored portion and the non-colored portion.

Hence, the object of the present invention is to provide a thermosensitive recording sheet having (a) much higher color-forming sensitivity than in the case of using conventional sensitizers and (b) excellent stability at the colored portion and the non-colored portion.

As a result of extensive investigation, the present inventors found that the above object can be achieved by using, as a sensitizer, a substituted or unsubstituted phenacyl ether compound or a substituted or unsubstituted phenacyl sulfide compound.

According to the present invention, there is provided a thermosensitive recording sheet comprising a substrate sheet and coated on the substrate, a film comprising a color-forming lactone compound, an acidic substance and a sensitizer, said sensitizer being a substituted or unsubstituted phenacyl ether compound or a substituted or unsubstituted phenacyl sulfide compound.

The substituted or unsubstituted phenacyl ether compound or substituted or unsubstituted phenacyl sulfide compound used as a sensitizer in the present invention includes, for example, phenacyl derivatives represented by the following general formulas (I) and (II).

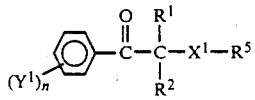

(I)

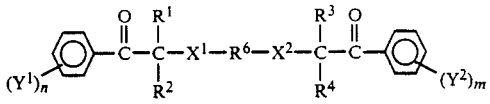

(II)

wherein $X^1$ and $X^2$ represent an oxygen atom or a sulfur atom; $Y^1$ and $Y^2$ represent a hydrogen atom, a halogen atom, an alkyl group, an aryl group, an alkyloxy group, an acyl group, a hydroxyl group or a nitro group; $R^1$, $R^2$, $R^3$ and $R^4$ represent a hydrogen atom, a halogen atom or an alkyl group; $R^5$ represents an aryl group, an aralkyl group, a phenacyl group, a cycloalkyl group, an acyl group, a furfuryl group or a pyridyl group; $R^6$ represents a phenylene group, an alkylene group, a xylylene group, or an alkylene group containing in the chain an ether bond, a sulfide bond or an ester bond; with the proviso that the aryl group, aralkyl group, phenacyl group, cycloalkyl group, phenylene group, alkylene group and xylylene group defined for $Y^1$, $Y^2$, $R^5$ and $R^6$ may have substituents; and n and m represent an integer of 1-5.

The substituent for $R^5$ when $R^5$ is an aryl group, an aralkyl group, a phenacyl group or a cycloalkyl group and the substituents for $Y^1$ and $Y^2$ when $Y^1$ and $Y^2$ are an aryl group, include, for example, a halogen atom, a nitro group, an alkyl group, an alkenyl group, an aralkyl group, an aryl group, an alkyloxy group, an aralkyloxy group, an aryloxy group, an acyl group, an acyloxy group, an alkyloxycarbonyl group, an aralkyloxycarbonyl group, an aryloxycarbonyl group, an acylalkyloxy group and a hydroxyl group. The substituent for $R^6$ when $R^6$ is a phenylene group, an alkylene group or a xylylene group, includes, for example, a halogen atom, an alkyl group, an alkyloxy group and an acyl group.

Specific examples of $R^5$ include unsubstituted aryl groups such as phenyl, α-naphthyl, β-naphthyl and the like; substituted aryl groups such as chlorophenyl, dichlorophenyl, trichlorophenyl, pentachlorophenyl, bromophenyl, dibromophenyl, tribromophenyl, pentabromophenyl, iodophenyl, nitrophenyl, toluyl, xylyl, tert-butylphenyl, tert-octylphenyl, 4-methyl-2,6-di-tert-butylphenyl, 4-ethyl-2,6-di-tert-butylphenyl, 4-propenyl-2-methoxyphenyl, 4-allyl-2-methoxyphenyl, benzylphenyl, cumylphenyl, biphenyl, methoxyphenyl, ethoxyphenyl, benzyloxyphenyl, phenoxyphenyl, acetylphenyl, 2-benzoyl-5-methoxyphenyl, 2-benzoyl-5-octyloxyphenyl, 2-benzoyl-5-dodecyloxyphenyl, acetyloxyphenyl, benzoyloxyphenyl, methoxycarbonylphenyl, ethoxycarbonylphenyl, propoxycarbonylphenyl, isopropoxycarbonylphenyl, butoxycarbonylphenyl, isobutoxycarbonylphenyl, isoamyloxycarbonylphenyl, benzyloxycarbonylphenyl, phenoxycarbonylphenyl, p-tert-butylphenoxycarbonylphenyl, p-tert-octylcarbonylphenyl, benzoylmethoxyphenyl, benzoylmethoxytoluyl, benzoylmethoxyxylyl, benzoylmethoxychlorophenyl, benzoylmethoxycumylphenyl, benzoylmethoxybenzoylphenyl, hydroxyphenyl, hydroxytoluyl, hydroxyxylyl, hydroxychlorophenyl, hydroxycumylphenyl, benzoylhydroxyphenyl and the like; unsubstituted aralkyl groups such as benzyl, phenethyl, naphthylmethyl and the like; substituted aralkyl groups such as o-chlorobenzyl, m-chlorobenzyl, p-chlorobenzyl, bromobenzyl, methylbenzyl, tert-butylbenzyl, isopropylbenzyl, α,α-dimethylbenzyl, α-phenylbenzyl, methoxybenzyl, phenoxybenzyl and the like; a phenacyl group; substituted phenacyl groups such as chlorophenacyl, bromophenacyl, iodophenacyl, methylphenacyl, phenylphenacyl, methoxyphenacyl, nitrophenacyl and the like; substituted or unsubstituted cycloalkyl groups such as cyclohexyl, methylcyclohexyl and the like; acyl groups such as benzoyl, chlorobenzoyl, methylbenzoyl, naphthoyl and the like; a furfuryl group; and a pyridyl group.

Specific examples of $Y^1$ and $Y^2$ when they are a substituted or unsubstituted aryl group include the same substituted or unsubstituted aryl groups as mentioned above as the specific examples of $R^5$.

Specific examples of $R^6$ include unsubstituted phenylene groups such as o-phenylene, m-phenylene, p-phenylene and the like; substituted phenylene groups such as 3-methyl-o-phenylene, 4-methyl-o-phenylene, 2-methyl-o-phenylene, 2-methyl-p-phenylene, 4-chloro-m-phenylene, 2-chloro-p-phenylene, 4-benzoyl-m-phenylene and the like; unsubstituted alkylene groups such as methylene, ethylene, propylene, butylene, hexylene and the like; substituted alkylene groups such as chloroethylene, cyclopropylene, dimethylpropylene and the like; o-, m- and p-xylylene groups; and alkylene groups containing in the chain an ether bond, a sulfide bond or an ester bond, such as 3-oxypentylene, 3,6-dioxyoctylene, 3-thiopentylene, 3,5-dioxy-2,6-dioneoctylene and the like.

Specific examples of the phenacyl groups are unsubstituted phenacyl groups and substituted phenacyl groups such as chlorophenacyl, bromophenacyl, iodophenacyl, methylphenacyl, phenylphenacyl, methoxyphenacyl, nitrophenacyl and the like.

Of the above substituted or unsubstituted phenacyl ether compounds and substituted or unsubstituted phenacyl sulfide compounds, there are preferred those having a melting point of 60°–180° C., in view of their excellency in (a) color-forming sensitivity when heated and (b) stability of the colored portion and the non-colored portion. As specific examples of such compounds, there can be mentioned the following phenacyl derivatives (1) to (103):

(1) β-naphthyl phenacyl ether,
(2) α-naphthyl phenacyl ether,
(3) phenyl phenacyl ether,
(4) o-chlorophenyl phenacyl ether,
(5) m-chlorophenyl phenacyl ether,
(6) p-chlorophenyl phenacyl ether,
(7) 2,4-dichlorophenyl phenacyl ether,
(8) 2,4,6-trichlorophenyl phenacyl ether,
(9) o-bromophenyl phenacyl ether,
(10) m-bromophenyl phenacyl ether,
(11) p-bromophenyl phenacyl ether,
(12) 2,4-dibromophenyl phenacyl ether,
(13) 2,4,6-tribromophenyl phenacyl ether,
(14) o-toluyl phenacyl ether,
(15) p-tert-butylphenyl phenacyl ether,
(16) p-tert-octylphenyl phenacyl ether,
(17) 2-methoxy-4-allylphenyl phenacyl ether,
(18) p-benzylphenyl phenacyl ether,
(19) p-α-cumylphenyl phenacyl ether,
(20) o-biphenyl phenacyl ether,
(21) m-biphenyl phenacyl ether,
(22) p-biphenyl phenacyl ether,
(23) o-methoxyphenyl phenacyl ether,
(24) p-methoxyphenyl phenacyl ether,
(25) o-ethoxyphenyl phenacyl ether,
(26) p-benzyloxyphenyl phenacyl ether,
(27) p-phenoxyphenyl phenacyl ether,
(28) m-methylcarbonylphenyl phenacyl ether,
(29) p-methylcarbonylphenyl phenacyl ether,
(30) 2-benzoyl-5-methoxyphenyl phenacyl ether,
(31) 2-benzoyl-5-octyloxyphenyl phenacyl ether,
(32) 3-acetoxyphenyl phenacyl ether,
(33) 3-benzoyloxyphenyl phenacyl ether,
(34) 4-methoxycarbonylphenyl phenacyl ether,
(35) 4-ethoxycarbonylphenyl phenacyl ether,
(36) 4-n-propoxycarbonylphenyl phenacyl ether,
(37) 4-isopropoxycarbonylphenyl phenacyl ether,
(38) 4-n-butoxycarbonylphenyl phenacyl ether,
(39) 4-isobutoxycarbonylphenyl phenacyl ether,
(40) 4-benzyloxycarbonylphenyl phenacyl ether,
(41) 4-phenoxycarbonylphenyl phenacyl ether,
(42) catechol diphenacyl ether,
(43) resorcin diphenacyl ether,
(44) hydroquinone diphenacyl ether,
(45) 4-benzoylresorcin diphenacyl ether,
(46) catechol monophenacyl ether,
(47) resorcin monophenacyl ether,
(48) hydroquinone monophenacyl ether,
(49) 4-benzoylresorcin monophenacyl ether,
(50) o-nitrophenyl phenacyl ether,
(51) p-nitrophenyl phenacyl ether,
(52) phenyl 4-phenylphenacyl ether,
(53) 4-phenoxyphenyl 4-phenylphenacyl ether,
(54) phenyl 4-chlorophenacyl ether,
(55) 4-benzyloxyphenyl 4-chlorophenacyl ether,
(56) m-tolyl 4-bromophenacyl ether,
(57) p-benzylphenyl 4-bromophenacyl ether,
(58) p-biphenyl 4-methylphenacyl ether,
(59) β-naphthyl 4-methylphenacyl ether,
(60) 3,5-xylyl 4-nitrophenacyl ether,
(61) 2,5-xylyl 4-nitrophenacyl ether,
(62) p-biphenyl 3-methoxyphenacyl ether,
(63) phenyl 4-bromophenacyl sulfide,
(64) phenyl 4-phenylphenacyl sulfide,
(65) 2-naphthyl phenacyl sulfide,
(66) 2-naphthyl 4-methylphenacyl sulfide,
(67) 4-chlorophenyl phenacyl sulfide,
(68) 2-chlorophenyl phenacyl sulfide,
(69) 4-bromophenyl phenacyl sulfide,
(70) 4-methylphenyl 4-chlorophenacyl sulfide,
(71) 2-methylphenyl 4-phenylphenacyl sulfide,
(72) 4-tert-butylphenyl 4-nitrophenacyl sulfide,
(73) 4-methoxyphenyl 4-bromophenacyl sulfide,
(74) 2-hydroxyphenyl phenacyl sulfide,
(75) 4-hydroxyphenyl phenacyl sulfide,
(76) 4-hydroxyphenyl 4-methylphenacyl sulfide,
(77) 4-nitrophenyl phenacyl sulfide,
(78) 2-nitrophenyl phenacyl sulfide,
(79) benzyl phenacyl sulfide,
(80) 4-methylbenzyl phenacyl sulfide,
(81) 4-chlorobenzyl phenacyl sulfide,
(82) cyclohexyl 4-nitrophenacyl sulfide,
(83) furfuryl phenacyl sulfide,
(84) furfuryl 4-nitrophenacyl sulfide,
(85) 2-pyridyl 4-nitrophenacyl sulfide,
(86) 4-pyridyl phenacyl sulfide,
(87) diphenacyl sulfide,
(88) bis(4-chlorophenacyl) sulfide,
(89) bis(4-bromophenacyl) sulfide,
(90) 1,2-ethylene diphenacyl sulfide,
(91) bis[2-(4-phenylphenacylthio)ethyl]ether,
(92) 1,2-phenylene diphenacyl sulfide,

(93) 1,4-phenylene diphenacyl sulfide,
(94) 4-methyl-1,2-phenylene diphenacyl sulfide,
(95) p-xylylene diphenacyl sulfide,
(96) ethyleneglycol-bis(4-chlorophenacylthioacetic acid) ester,
(97) ethyleneglycol-bis(4-bromophenacylthioacetic acid) ester,
(98) phenacyl benzoyl sulfide,
(99) phenacyl 1-naphthoyl sulfide,
(100) phenacyl 2-naphthoyl sulfide,
(101) phenacyl 4-methylbenzoyl sulfide,
(102) phenacyl 4-chlorobenzoyl sulfide, and
(103) phenacyl 4-hydroxybenzoyl sulfide.

Preferred of these are phenacyl derivatives (1), (4), (8), (11), (20), (22), (23), (25), (28), (29), (30), (33), (34), (35), (39), (40), (43), (45), (46), (50), (51), (52), (53), (55), (56), (57), (58), (62), (65), (66), (67), (69), (70), (71), (73), (75), (76), (77), (79), (80), (81), (82), (84), (85), (88), (89), (90), (93), (94), (95), (96), (97) and (98). Particularly preferred are phenacyl derivatives having a melting point of 85°-120° C. As specific examples, there can be mentioned phenacyl derivatives (4), (11), (22), (50), (52), (55), (57), (65), (70), (77), (80), (81), (89) and (95).

Examples of the color-forming lactone compound used in this invention include fluoranphthalides such as 3,3-bis(p-dimethylaminophenyl)phthalide, 3,3-bis(p-dimethylaminophenyl)-6-dimethylaminophthalide (also known as Crystal Violet Lactone; CVL for short), 3,3-bis(p-dimethylaminophenyl)-6-aminophthalide, 3,3-bis(p-dimethylaminophenyl)-6-nitrophthalide, 3,3-bis(p-dimethylaminophenyl)phthalide, 3,3-bis-3-dimethylamino-7-methylfluoran, 3-diethylamino-7-chlorofluoran, 3-diethylamino-6-chloro-7-methylfluoran, 3-diethylamino-7-anilinofluoran, 3-diethylamino-6-methyl-7-anilinofluoran, 3-piperidino-6-methyl-7-anilinofluoran, 3-(N-ethyl-p-toluidino)-7-(N-methylanilino)-fluoran, 3-(N-ethyl-p-tolidino)-6-methyl-7-anilinofluoran, 3-N-ethyl-N-isoamylamino-6-methyl-7-anilinofluoran, 3-N-methyl-N-cyclohexylamino-6-methyl-7-anilinofluoran and 3-N,N-diethylamino-7-o-chloroanilinofluoran; lactams such as Rhodamin B lactam; and spiropyrans such as 3-methylspirodinaphtopyran, 3-ethylspirodinaphthopyran and 3-benzylspironaphthopyran. These compounds should be colorless or pale-colored and react with acidic substances to form colors.

The acidic substance used in this invention may be any acidic substrance which is solid at room temperature and when heated to about 60° to 180° C., is melted and opens the lactone ring of the color-forming lactone compound to form a color. Examples of the acidic substance include 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenediphenol (also known as bisphenol A), 4,4'-isopropylidenebis(2-chlorophenol), 4,4'-isopropylidene-bis(2-methylphenol), 4,4'-ethylenebis(2-methylphenol), 4,4'-thiobis(6-t-butyl-3-methylphenol), 1,1-bis(4-hydroxyphenyl)-cyclohexane, 2,2'-bis(4-hydroxyphenyl)-n-heptane, 4,4'-cyclohexylidenebis(2-isopropylphenol), 4,4'-sulfonyldiphenol, salicylanilide, novolak-type phenolic resin and benzyl p-hydroxybenzoate.

The acidic substance is used in an amount of usually 10 to 1,000 parts by weight (all parts hereinafter are by weight), preferably 100 to 500 parts, per 100 parts of the color-forming lactone compound.

The sensitizer is used in an amount of usually 1 to 1,000 parts, preferably 30 to 100 parts, per 100 parts of the acidic substance.

The color-forming lactone compound, the acidic substance and the sensitizer are used in the form of fine particles, preferably fine particles having particle diameters of several microns or less.

Various known methods can be used to produce the thermosensitive recording sheet. Usually, there may be used (1) a method which comprises preparing a coating dispersion of the color forming lactone compound, the acidic substance and the sensitizer in water or an organic solvent, and coating the coating dispersion on a sheet substrate, and (2) a method which comprises dispersing the color-forming lactone compound and the acidic substance separately in water or an organic solvent to prepare two coating dispersions, including the sensitizer into at least one of the coating dispersions, and coating the coating dispersions in superimposed relation on a sheet substrate. Needless to say, to the above coating dispersions must be added a water-soluble binder such as polyvinyl alcohol, methyl cellulose, hydroxyethyl cellulose, carboxymethyl cellulose, starch, styrene-maleic acid copolymer or the like, or an oil-soluble binder such as polyacrylate, polystyrene, polyester, polyolefin, polycarbonate, polyurethane, polyvinyl chloride, polyvinyl acetate or the like. To the coating dispersion may further be added as necessary, in order to improve the performance, an U.V. absorber (e.g. benzophenone derivatives, triazole derivatives), a filler (e.g. calcium carbonate), a lubricant (e.g. polyethylene wax, paraffin wax), an agent for imparting water resistance and various other chemicals. Various dispersing agents for dispersing the various chemicals in water may also be added to the above coating dispersions.

The coating dispersion is coated on a sheet substrate so that its dry weight becomes generally 2 to 12 g/m$^2$ of the sheet substrate, and then dried at room temperature to about 50° C. to give the thermosensitive recording sheet of the invention.

Paper is generally used as the sheet substrate, but plastic sheets and nonwoven sheets may also be used.

The present invention is explained more specifically below by way of Examples, Comparative Examples and Test Example. However, the present invention is in no way restricted to these Examples. In the Examples, parts and % are by weight.

EXAMPLE 1

| | |
|---|---|
| [Dispersion A (containing a dye)] | |
| 3-(N-ethyl-p-toluidino)-6-methyl-7-anilinofluoran | 1.0 part |
| o-Chlorophenyl phenacyl ether | 2.0 parts |
| 10% Aqueous solution of polyvinyl alcohol | 3.0 parts |
| Water | 5.0 parts |
| Total | 11.0 parts |
| [Dispersion B (containing an acidic substance)] | |
| Bisphenol A | 3.0 parts |
| Calcium carbonate | 3.0 parts |
| Zinc stearate | 0.5 part |
| 10% Aqueous solution of polyvinyl alcohol | 7.0 parts |
| Water | 10.0 parts |
| Total | 23.5 parts |

Two coating dispersions, dispersion A and dispersion B, were independently prepared by mixing the above components in the above proportions and pulverizing and dispersing them by a paint conditioner.

Then, 11.0 parts of dispersion A and 23.5 parts of dispersion B were mixed to form a thermosensitive coating dispersion. It was coated on high-quality paper of 64.5 g/m$^2$ so that the coated amount upon drying became 8 g/m$^2$, and then dried to obtain a thermosensitive recording sheet in accordance with the present invention.

This sheet had excellent color-forming sensitivity and excellent stability at the colored and non-colored portions.

EXAMPLES 2–53

Thermosensitive recording sheets of the present invention were obtained in the same procedure as in Example 1 except that the o-chlorophenyl phenacyl ether used in Example 1 was replaced by the above-mentioned phenacyl derivatives (1), (8), (11), (20), (22), (23), (25), (28), (29), (30), (33), (34), (35), (39), (40), (43), (45), (46), (50), (51), (52), (53), (55), (56), (57), (58), (62), (65), (66), (67), (69), (70), (71), (73), (75), (76), (77), (79), (80), (81), (82), (84), (85), (88), (89), (90), (93), (94), (95), (96), (97) and (98).

All of these sheets had excellent color-forming sensitivity and excellent stability at the colored and non-colored portions.

EXAMPLE 54

A thermosensitive recording sheet of the present invention was obtained in the same procedure as in Example 1 except that the amount of o-chlorophenyl phenacyl ether used was changed to 1.0 part and the amount of dispersion A used was changed to 10 parts.

This sheet had excellent color-forming sensitivity and excellent stability at the colored and non-colored portions.

EXAMPLE 55

A thermosensitive recording sheet of the present invention was obtained in the same procedure as in Example 1 except that the amount of o-chlorophenyl phenacyl ether used was changed to 4.0 parts and the amount of dispersion A used was changed to 13 parts.

This sheet had excellent color-forming sensitivity and excellent stability at the colored and non-colored portions.

COMPARATIVE EXAMPLE 1

A thermosensitive recording sheet for comparison was obtained in the same procedure as in Example 1 except that no o-chlorophenyl phenacyl ether was used and the amount of dispersion A used was changed to 9.0 parts.

This sheet had inferior color-forming sensitivity.

COMPARATIVE EXAMPLE 2

A thermosensitive recording sheet for comparison was obtained in the same procedure as in Example 1 except that o-chlorophenyl phenacyl ether was replaced by stearamide.

This sheet had inferior color-forming sensitivity and inferior stability at the colored and non-colored portions.

COMPARATIVE EXAMPLE 3

A thermosensitive recording sheet for comparison was obtained in the same procedure as in Example 1 except that no o-chlorophenyl phenacyl ether was used, the amount of dispersion A used was changed to 9 parts and bisphenol A was replaced by benzyl p-hydroxybenzoate.

This sheet had inferior color-forming sensitivity and inferior stability at the colored and non-colored portions.

TEST EXAMPLE 1

The thermosensitive recording sheets obtained in Examples 1–55 and Comparative Examples 1–3 were evaluated as follows for color-forming sensitivity and stability at the colored and non-colored portions. The results are shown in Table 1.

[Evaluation of color-forming sensitivity]

An image was printed on a thermosensitive recording sheet by means of a thermal head printing device (Model MSI, made by Matsushita Electronic Components Co., Ltd.) with a pulse width of 0.1–1.0 millisecond, and the density of the image was measured by a Macbeth densitometer (RD-918, made by Macbeth Co.). Then, an image density-pulse width curve was prepared. From the curve was obtained a pulse width when the image density became 1.0. The color-forming sensitivity of the thermosensitive recording sheet was evaluated based on the value of the pulse width (the smaller the value of the pulse width, the higher the color-forming sensitivity).

[Evaluation of stability at the colored and non-colored portions]

A thermosensitive recording sheet on which an image had been printed under the same conditions as above, was evaluated for stability at the colored and non-colored portions, under the following two conditions (condition A and condition B).

(Condition A)

The above sheet was allowed to stand for 24 hours in an atmosphere of 60° C. and 25% RH and then evaluated for whitening and color disappearance of the colored portion as well as for background fog of the non-colored portion, visually based on the following scale.

1. Evaluation of the colored portion
   (1) Scale of evaluation of whitening
   - ◎ : No whitening
   - ○ : Hardly any whitening
   - Δ: Whitening occurred
   - X: Marked whitening (2) Scale of evaluation of color disappearance
   - ◎ : No color disappearance
   - ○ : Hardly any color disappearance
   - Δ: Color disappearance occurred
   - X: Marked color disappearance
2. Evaluation of the non-colored portion
   (1) Scale of evaluation of background fog
   - ◎ : No background fog
   - ○ : Hardly any background fog
   - Δ: Background fog occurred
   - X: Marked background fog (Condition B)

The above sheet was allowed to stand for 24 hours in an atmosphere of 40° C. and 90% RH and then evaluated for color disappearance of the colored portion, visually based on the same scale as in the condition A.

TABLE 1

| | Phenacyl derivative | Color-forming sensitivity | Stability of colored portion: Condition A: Whitening | Stability of colored portion: Condition A: Color disappearance | Stability of colored portion: Condition B: Color disappearance | Stability of non-colored portion: Condition A: Background fog |
|---|---|---|---|---|---|---|
| Example | | | | | | |
| 1 | (4) | 0.47 | ◎ | ◎ | ◎ | ◎ |
| 2 | (1) | 0.59 | ◎ | ○ | ◎ | ◎ |
| 3 | (8) | 0.51 | ○ | ◎ | ◎ | ◎ |
| 4 | (11) | 0.52 | ◎ | ◎ | ◎ | ◎ |
| 5 | (20) | 0.51 | ○ | ◎ | ◎ | ◎ |
| 6 | (22) | 0.52 | ◎ | ◎ | ◎ | ◎ |
| 7 | (23) | 0.51 | ○ | ○ | ○ | ○ |
| 8 | (25) | 0.42 | ◎ | ◎ | ○ | ○ |
| 9 | (28) | 0.50 | ○ | ◎ | ○ | ◎ |
| 10 | (29) | 0.54 | ○ | ◎ | ◎ | ◎ |
| 11 | (30) | 0.56 | ◎ | ◎ | ◎ | ◎ |
| 12 | (33) | 0.53 | ○ | ◎ | ◎ | ◎ |
| 13 | (34) | 0.54 | ◎ | ○ | ◎ | ◎ |
| 14 | (35) | 0.54 | ◎ | ◎ | ◎ | ◎ |
| 15 | (39) | 0.55 | ◎ | ◎ | ◎ | ◎ |
| 16 | (40) | 0.54 | ◎ | ◎ | ◎ | ◎ |
| 17 | (43) | 0.54 | ◎ | ◎ | ◎ | ◎ |
| 18 | (45) | 0.67 | ◎ | ◎ | ◎ | ◎ |
| 19 | (46) | 0.55 | ◎ | ◎ | ◎ | ◎ |
| 20 | (50) | 0.52 | ◎ | ◎ | ◎ | ◎ |
| 21 | (51) | 0.56 | ◎ | ◎ | ◎ | ◎ |
| 22 | (52) | 0.50 | ◎ | ◎ | ◎ | ◎ |
| 23 | (53) | 0.51 | ○ | ◎ | ◎ | ◎ |
| 24 | (55) | 0.49 | ◎ | ◎ | ◎ | ◎ |
| 25 | (56) | 0.49 | ◎ | ○ | ◎ | ◎ |
| 26 | (57) | 0.50 | ◎ | ◎ | ◎ | ◎ |
| 27 | (58) | 0.51 | ○ | ◎ | ◎ | ◎ |
| 28 | (62) | 0.54 | ○ | ◎ | ◎ | ◎ |
| 29 | (65) | 0.44 | ◎ | ◎ | ◎ | ◎ |
| 30 | (66) | 0.42 | ◎ | ◎ | ◎ | ○ |
| 31 | (67) | 0.48 | ◎ | ◎ | ◎ | ○ |
| 32 | (69) | 0.43 | ○ | ◎ | ○ | ◎ |
| 33 | (70) | 0.44 | ◎ | ◎ | ◎ | ◎ |
| 34 | (71) | 0.53 | ◎ | ◎ | ◎ | ◎ |
| 35 | (73) | 0.52 | ◎ | ◎ | ◎ | ○ |
| 36 | (75) | 0.52 | ◎ | ◎ | ◎ | ◎ |
| 37 | (76) | 0.56 | ◎ | ◎ | ◎ | ◎ |
| 38 | (77) | 0.49 | ◎ | ◎ | ◎ | ◎ |
| 39 | (79) | 0.46 | ◎ | ○ | ◎ | ◎ |
| 40 | (80) | 0.47 | ◎ | ◎ | ◎ | ◎ |
| 41 | (81) | 0.49 | ◎ | ◎ | ◎ | ◎ |
| 42 | (82) | 0.46 | ○ | ◎ | ◎ | ◎ |
| 43 | (84) | 0.53 | ○ | ◎ | ○ | ◎ |
| 44 | (85) | 0.54 | ◎ | ◎ | ○ | ◎ |
| 45 | (88) | 0.53 | ◎ | ◎ | ◎ | ◎ |
| 46 | (89) | 0.46 | ◎ | ◎ | ◎ | ◎ |
| 47 | (90) | 0.44 | ◎ | ◎ | ○ | ○ |
| 48 | (93) | 0.53 | ◎ | ◎ | ◎ | ○ |
| 49 | (94) | 0.55 | ○ | ◎ | ◎ | ◎ |
| 50 | (95) | 0.46 | ◎ | ◎ | ◎ | ◎ |
| 51 | (96) | 0.58 | ◎ | ◎ | ◎ | ◎ |
| 52 | (97) | 0.53 | ○ | ◎ | ○ | ◎ |
| 53 | (98) | 0.52 | ○ | ◎ | ◎ | ○ |
| 54 | (4) | 0.45 | ◎ | ◎ | ◎ | ◎ |
| 55 | (4) | 0.41 | ◎ | ◎ | ◎ | ○ |
| Comparative Example | | | | | | |
| 1 | — | 0.71 | ○ | Δ | X | ◎ |
| 2 | — | 0.61 | Δ | Δ | Δ | Δ |
| 3 | — | 0.60 | X | Δ | Δ | ○ |

What is claimed is:

1. A thermosensitive recording sheet comprising a substrate sheet and coated on the substrate, a film comprising a color-forming lactone compound, an acidic substance and a sensitizer, wherein the sensitizer is at least one compound selected from the group consisting of the phenacyl ether compounds and phenacyl sulfide compounds represented by the following general formulas (I) and (II)

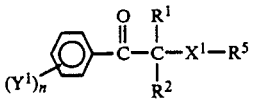

(I)

-continued

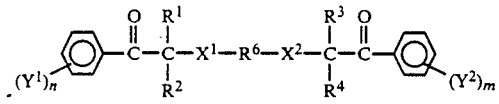

(II)

wherein $X^1$ and $X^2$ represent an oxygen atom or a sulfur atom; $Y^1$ and $Y^2$ represent a hydrogen atom, a halogen atom, an alkyl group, an aryl group, an alkyloxy group, an acyl group, a hydroxyl group or a nitro group; $R^1$, $R^2$, $R^3$ and $R^4$ represent a hydrogen atom, a halogen atom or an alkyl group; $R^5$ represents an aryl group, an aralkyl group, a phenacyl group, a cycloalkyl group, an acyl group, a furfuryl group or a pyridyl group; $R^6$ represents a phenylene group, an alkylene group, a xylylene group, or an alkylene group containing in the chain an ether bond, a sulfide bond or an ester bond; with the proviso that the aryl group, aralkyl group, phenacyl group, cycloalkyl group, phenylene group, alkylene group and xylylene group defined for $Y^1$, $Y^2$, $R^5$ and $R^6$ may have substituents; and n and m represent an integer of 1–5.

2. The thermosensitive recording sheet of claim 1 wherein the sensitizer is at least one compound selected from the group consisting of the following phenacyl derivatives:

(1) β-naphthyl phenacyl ether,
(4) o-chlorophenyl phenacyl ether,
(8) 2,4,6-trichlorophenyl phenacyl ether,
(11) p-bromophenyl phenacyl ether,
(20) o-biphenyl phenacyl ether,
(22) p-biphenyl phenacyl ether,
(23) o-methoxyphenyl phenacyl ether,
(25) o-ethoxyphenyl phenacyl ether,
(28) m-methylcarbonylphenyl phenacyl ether,
(29) p-methylcarbonylphenyl phenacyl ether,
(30) 2-benzoyl-5-methoxyphenyl phenacyl ether,
(33) 3-benzoyloxyphenyl phenacyl ether,
(34) 4-methoxycarbonylphenyl phenacyl ether,
(35) 4-ethoxycarbonylphenyl phenacyl ether,
(39) 4-isobutoxycarbonylphenyl phenacyl ether,
(40) 4-benzyloxycarbonylphenyl phenacyl ether,
(43) resorcin diphenacyl ether,
(45) 4-benzoylresorcin diphenacyl ether,
(46) catechol monophenacyl ether,
(50) o-nitrophenyl phenacyl ether,
(51) p-nitrophenyl phenacyl ether,
(52) phenyl 4-phenylphenacyl ether,
(53) 4-phenoxyphenyl 4-phenylphenacyl ether,
(55) 4-benzyloxyphenyl 4-chlorophenacyl ether,
(56) m-tolyl 4-bromophenacyl ether,
(57) p-benzylphenyl 4-bromophenacyl ether,
(58) p-biphenyl 4-methylphenacyl ether,
(62) p-biphenyl 3-methoxyphenacyl ether,
(65) 2-naphthyl phenacyl sulfide,
(66) 2-naphthyl 4-methylphenacyl sulfide,
(67) 4-chlorophenyl phenacyl sulfide,
(69) 4-bromophenyl phenacyl sulfide,
(70) 4-methylphenyl 4-chlorophenacyl sulfide,
(71) 2-methylphenyl 4-phenylphenacyl sulfide,
(73) 4-methoxyphenyl 4-bromophenacyl sulfide,
(75) 4-hydroxyphenyl phenacyl sulfide,
(76) 4-hydroxyphenyl 4-methylphenacyl sulfide,
(77) 4-nitrophenyl phenacyl sulfide,
(79) benzyl phenacyl sulfide,
(80) 4-methylbenzyl phenacyl sulfide,
(81) 4-chlorobenzyl phenacyl sulfide,
(82) cyclohexyl 4-nitrophenacyl sulfide,
(84) furfuryl 4-nitrophenacyl sulfide,
(85) 2-pyridyl 4-nitrophenacyl sulfide,
(88) bis(4-chlorophenacyl) sulfide,
(89) bis(4-bromophenacyl) sulfide,
(90) 1,2-ethylene diphenacyl sulfide,
(93) 1,4-phenylene diphenacyl sulfide,
(94) 4-methyl-1,2-phenylene diphenacyl sulfide,
(95) p-xylylene diphenacyl sulfide,
(96) ethyleneglycol-bis(4-chlorophenacylthioacetic acid) ester,
(97) ethyleneglycol-bis(4-bromophenacylthioacetic acid) ester, and
(98) phenacyl benzoyl sulfide.

3. The thermosensitive recording sheet of claim 2 wherein the amount of the sensitizer in the coated film is 30–100 parts by weight per 100 parts by weight of the acidic substance.

4. The thermosensitive recording sheet of claim 1 wherein the sensitizer is at least one compound selected from the group consisting of the following phenacyl derivatives:

(4) o-chlorophenyl phenacyl ether,
(11) p-bromophenyl phenacyl ether,
(22) p-biphenyl phenacyl ether,
(50) o-nitrophenyl phenacyl ether,
(52) phenyl 4-phenylphenacyl ether,
(55) 4-benzyloxyphenyl 4-chlorophenacyl ether,
(57) p-benzylphenyl 4-bromophenacyl ether,
(65) 2-naphthyl phenacyl sulfide,
(70) 4-methylphenyl 4-chlorophenacyl sulfide,
(77) 4-nitrophenyl phenacyl sulfide,
(80) 4-methylbenzyl phenacyl sulfide,
(81) 4-chlorobenzyl phenacyl sulfide,
(89) bis(4-bromophenacyl) sulfide, and
(95) p-xylylene diphenacyl sulfide.

5. The thermosensitive recording sheet of claim 4 wherein the amount of the sensitizer in the coated film is 30–100 parts by weight per 100 parts by weight of the acidic substance.

6. The thermosensitive recording sheet of claim 1 wherein the amount of the sensitizer in the coated film is 30–100 parts by weight per 100 parts by weight of the acidic substance.

7. The thermosensitive recording sheet of claim 1 wherein the sensitizer comprises a phenacyl ether compound of formula (I).

8. The thermosensitive recording sheet of claim 1 wherein the sensitizer comprises a phenacyl sulfide compound of formula (I).

9. The thermosensitive recording sheet of claim 1 wherein the sensitizer comprises a phenacyl ether compound of formula (II).

10. The thermosensitive recording sheet of claim 1 wherein the sensitizer comprises phenacyl sulfide compound of formula (II).

11. The thermosensitive recording sheet of claim 1 wherein the sensitizer is at least one of said compounds of formula (I) and (II) having a melting point of from 85° C. to 120° C.

* * * * *